US007367211B2

(12) United States Patent
Ishida

(10) Patent No.: US 7,367,211 B2
(45) Date of Patent: May 6, 2008

(54) FORGING DEVICE AND METHOD FOR FORGING WORK

(75) Inventor: Hitoshi Ishida, Iwata (JP)

(73) Assignee: Createch Co., Ltd. (JP)

( * ) Notice: Subject to any disclaimer, the term of this patent is extended or adjusted under 35 U.S.C. 154(b) by 0 days.

(21) Appl. No.: 11/401,238

(22) Filed: Apr. 11, 2006

(65) Prior Publication Data

US 2006/0225480 A1 Oct. 12, 2006

(30) Foreign Application Priority Data

Apr. 12, 2005 (JP) ..... 2005-114118
Jan. 16, 2006 (JP) ..... 2006-006926

(51) Int. Cl.
*B21J 13/00* (2006.01)

(52) U.S. Cl. ..... 72/355.6; 72/355.4; 72/452.8; 72/453.06

(58) Field of Classification Search ..... 72/355.6, 72/355.4, 355.2, 353.2, 452.8, 452.9, 453.02, 72/453.06, 453.07
See application file for complete search history.

(56) References Cited

U.S. PATENT DOCUMENTS 3,805,581 A * 4/1974 Thibodeau ..... 72/407
5,746,085 A 5/1998 Harada et al.
6,178,801 B1 * 1/2001 Ishida ..... 72/354.2

FOREIGN PATENT DOCUMENTS

JP 2005-007468 1/2005
JP 2005007468 * 1/2005
WO WO 01/83135 A1 11/2001

* cited by examiner

*Primary Examiner*—Derris H. Banks
*Assistant Examiner*—Debra M Wolfe
(74) *Attorney, Agent, or Firm*—Bacon & Thomas, PLLC

(57) ABSTRACT

A forging device includes a die having an axis extending generally vertically. A work is placed in the die along the axis. First and second punches extend coaxially with the die and can interpose the work therebetween. A pressurizing section pressurizes the first and second punches toward the work generally simultaneously.

14 Claims, 10 Drawing Sheets

FORGING DEVICE AND METHOD FOR FORGING WORK

PRIORITY INFORMATION

The present application is based on and claims priority under 35 U.S.C. § 119 to Japanese Patent Applications No. 2005-114118, filed on Apr. 12, 2005 and No. 2006-6926, filed on Jan. 16, 2006, the entire contents of which are expressly incorporated by reference herein.

BACKGROUND OF THE INVENTION

1. Field of the Invention

The present invention generally relates to a forging device and a method for forging a work, and more particularly relates to a forging device suitable for forging a work having one or more teeth circumferentially and a forging method using the forging device.

2. Description of Related Art

A typical forging device has a clamp in a die section placed on a base to clamp a circular die. For example, the circular die has inner teeth along its internal surface for shaping gear teeth. A work is positioned at an upper portion of the die. The work is prepared for shaping a gear and having rough teeth along its outer surface. A punch presses the work downward from its top end to push it into the die so that the inner teeth of the die shape relatively fine gear teeth from the rough ones. For example, JP-A-2005-7468 discloses such a forging device.

The forging device, however, causes difficulty in highly accurately shaping the gear teeth, because the work is only pressed from the top end thereof. That is, a pressure given to the work is not uniform, and the pressure at the end pressurized by the punch is higher than the other end. In other words, the pressure is the highest at the top of the work and reduces toward the bottom of the work. Particularly, in shaping a helical gear, the accuracy can further deteriorate because pressures on both lateral sides of the gear are different from each other in addition to the imbalance of the pressure discussed above.

Thus, an improved forging device or forging method is required to more accurately shape a product having meshing teeth such as, for example, a gear, serration, spline or the like.

SUMMARY OF THE INVENTION

An aspect of the present invention involves the recognition of the need for a forging device or a forging method that can shape a product having high accuracy.

To address such a need, one aspect of the present invention involves a forging device that includes a die having an axis extending generally vertically. A work is placed in the die along the axis. First and second punches extend coaxially with the die and can interpose the work therebetween. A pressurizing section pressurizes the first and second punches toward the work generally simultaneously.

In accordance with another aspect of the present invention, a forging device includes a die laterally surrounding a work. A clamp clamps the die around the work. First and second press members press the work from top and bottom ends of the work. A third press member presses the die so that the die is locked in the clamp to firmly embrace the work. The third press member presses the die at least when the first and second press members press the work.

In accordance with a further aspect of the present invention, a method is provided for forging a work. The method includes placing a work in a die along an axis of the die, interposing the work between first and second punches which extend coaxially with the die, and pressurizing the first and second punches toward the work generally simultaneously.

BRIEF DESCRIPTION OF THE DRAWINGS

These and other features, aspects and advantages of the present invention are now described with reference to the drawings of preferred embodiments, which embodiments are intended to illustrate and not to limit the present invention, in which.

DETAILED DESCRIPTION OF THE INVENTION

Figure 1:
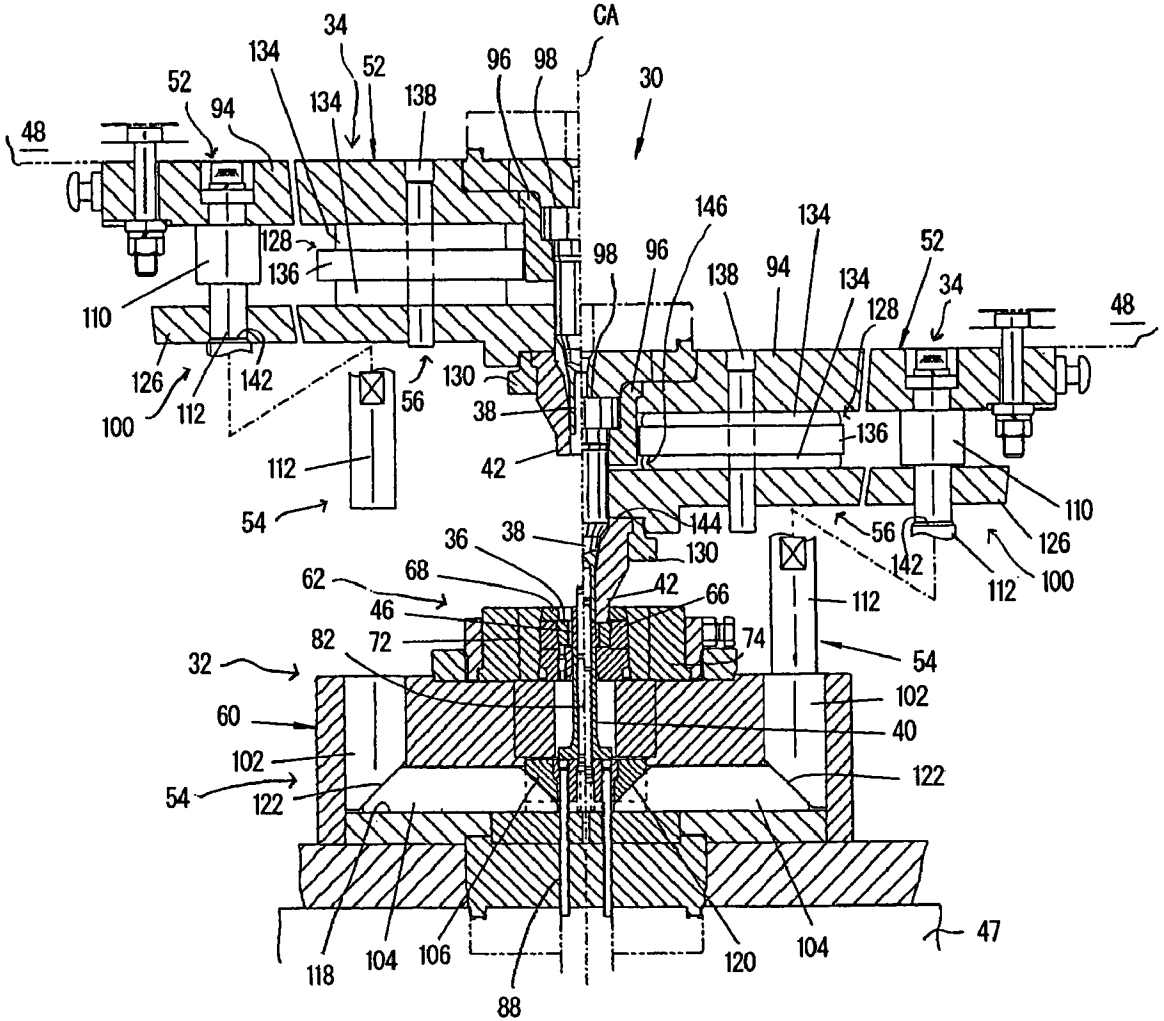
FIG. 1 is a cross sectional view of the major part of a forging device configured in accordance with a first embodiment of the present invention, the left half part of the figure relative to a center axis of the forging device showing the device in a stand-by (no load) state and the right half part of the figure showing the device in a completion state of its operation.
Figure 2:
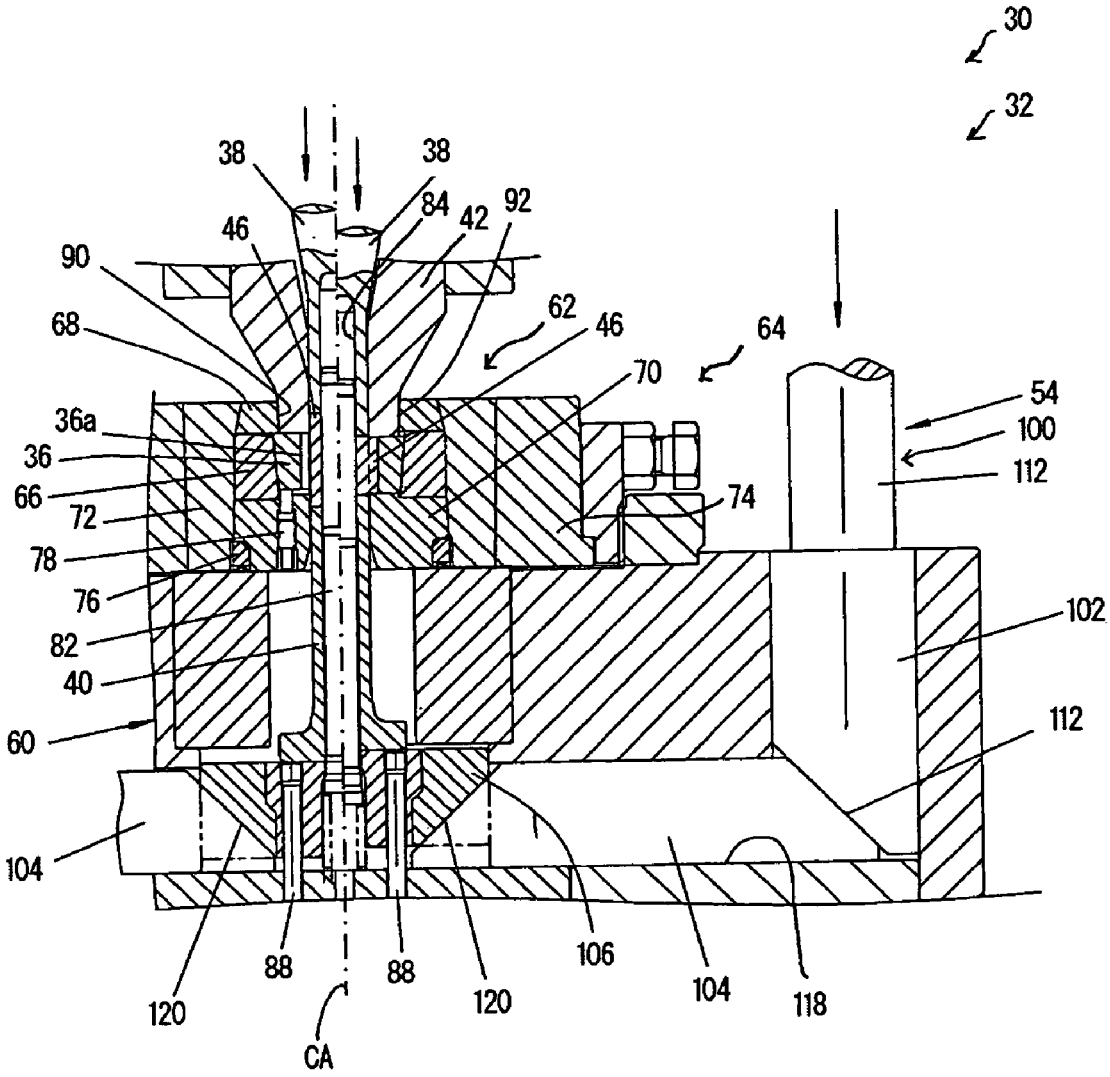
FIG. 2 is an enlarged cross sectional view of the forging device of FIG. 1, showing first, second and third die punches and a part of a die section of the forging device of FIG. 1, the left part of the figure relative to the center axis of the forging device showing the device in a state immediately before the first and second punches fully pressurize a work positioned therebetween and the right part of the figure showing the device in the completion state of its operation.
Figure 3:
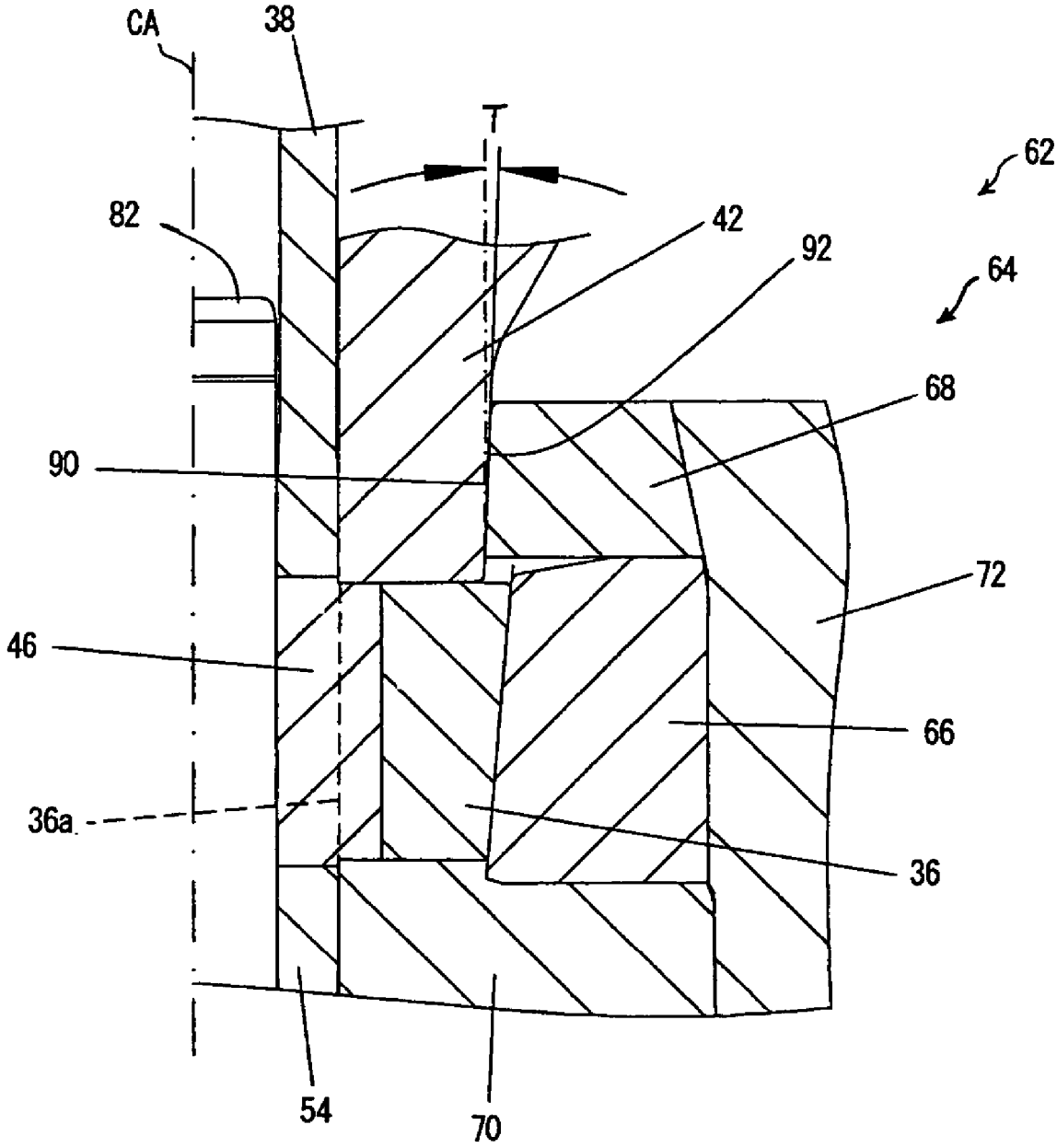
FIG. 3 is a further enlarged cross sectional view of the forging device of FIG. 1, partially showing the first, second and third die punches and a die unit of the die section of FIG. 2.

With reference to FIGS. 1-3, a forging device configured in accordance with a preferred embodiment (first embodiment) of the present invention will be described below. A preferred method for forging a work practiced by the forging device will be apparent with the descriptions of the forging device.

With reference to FIG. 1, a forging device 30 of the first embodiment is particularly suitable for cold forging works to shape products such as, for example, gears and spline shafts, i.e., products having teeth or the like therearound. Also, the forging device 30 in this embodiment is suitably applied for shaping half-finished products. In the illustrated embodiment, the forging device 30 forges cylindrical members (works) to shape helical gears having relatively rough teeth.

The illustrated forging device 30 is a mechanical system that differs from a hydraulic system, because the device 30 has no hydraulic components. The mechanical system is simpler than the hydraulic system. In addition, the responsibility of the mechanical system is superior to the responsibility of the hydraulic system.

The forging device 30 preferably includes a die section 32, a pressurizing section 34, a die 36, a first punch 38, a second punch 40 and a third punch 42.

The forging device 30 has a center axis CA extending vertically through the die section 32 and the pressurizing section 34. The die 36 has an axis and is placed on the die section 32 to extend coaxially with the die section 32. A cylindrical work 46 can be placed in the die 36 with its axis extending coaxially with the axes of the die 36 and the center axis CA of the die section 32. That is, the die 36 can laterally surrounds the work 46.

The die section 32 is preferably placed on a base 47. The pressurizing section 34 is positioned above the die section 32. A pressure generator such as, for example, a ram 48 is placed above the pressurizing section 34. The ram 48 generates relatively large pressure or pressurizing force and provides the pressure to the pressurizing section 34 so that the pressurizing section 34 moves downward toward the die section 32.

The pressurizing section 34 preferably includes a first pressurizing unit 52, a second pressurizing unit 54 and a third pressurizing unit 56. Because a single pressure generator, i.e., the ram 48 is employed in the illustrated embodiment, the first pressurizing unit 52 receives the entire pressurizing force from the ram 48, and portions of the force are provided to the second and third pressurizing units 54, 56. Alternatively, a plurality of pressure generators can be provided to individually generate pressure and provide the pressure to the respective pressurizing units 52, 54, 56.

The first punch 38 extends vertically along the center axis CA and is positioned right above the work 46. The first punch 38 pressurizes the work 46 downward from its top end. The second punch 40 also extends vertically along the center axis CA and is positioned right under the work 46. That is, the first and second punches 38, 40 interpose the work 46 therebetween in the axial and vertical direction. The second punch 40 pressurizes the work 46 upward from its bottom end when the first punch 38 pressurizes the work 46 downward. In other words, the second punch 40 receives the pressurizing force of the first punch 38 that travels through the work 46. The second punch 40 thus can be called "counter punch" or "backup punch."

The third punch 42 extends vertically along the center axis CA and along an outer surface of the first punch 38. That is, the third punch 42 laterally surrounds the first punch 38. The third punch 42 is positioned above the die 36 to pressurize the die 36 so that the die 36 locks the work 46. The third punch 42 can be called "die punch."

The first pressurizing unit 52 pressurizes the first punch 38. The second pressurizing unit 54 pressurizes the second punch 40. The third pressurizing unit 56 pressurizes the third punch 42. Preferably, the first and second punches 38, 40 generally simultaneously and generally equally pressurize the first and second punches 38, 40, respectively. Also, the third punch 42 preferably start pressing the die 36 before the first and second pressurizing units 52, 54 start pressurizing the first and second punches 38, 40.

With reference to FIGS. 1-3, the forging device 30 will be described in greater detail below.

The die section 32 preferably includes a base block 60 and a die unit 62 disposed above the base block 60. The die unit 62 is fixed to a top surface of the base block 60. The die unit 62 includes the die 36. The die 36 has a reversed trapezoidal cone shape. The die 36 is positioned in an upper center area around the axis of the die unit 62, i.e., the center axis CA of the die section 32. As shown in FIG. 3, the die 36 has inner teeth 36*a* for shaping outer teeth of a helical gear. The inner teeth 36*a* extend along an inner surface of the die 36. An outer surface of the die 36 preferably tapers downward. Preferably, an angle of the outer surface is approximately five degrees relative to the axis CA.

As best shown in FIG. 3, the die unit 62 preferably includes a clamp assembly 64. The illustrated clamp assembly 64 includes a die holder 66, an upper ring or stopper ring 68, a lower ring or receiving ring 70, an inner clamp 72 and an outer clamp 74 (FIG. 2). All of those components of the clamp assembly 64 have cylindrical or ring shapes which centers are consistent with the center axis CA.

The die holder 66 has an inner surface tapering downward along the outer surface of the die 36. The die 36 thus is fitted into the die holder 66. The die holder 66 is press-fitted into the inner clamp 72 to be fixed at a middle portion of the inner clamp 72 in the vertical direction.

The stopper ring 68 is fitted into an upper portion of the inner clamp 72. The receiving ring 70 is fitted into a lower portion of the inner clamp 72. The stopper ring 68 has an outer surface tapering upward, while the upper portion of the inner clamp 72 has an inner surface tapering upward along the outer surface of the stopper ring 68. As shown in the left part of FIG. 2, a top surface of the die 36 touches a bottom surface of the stopper ring 68 so that an upper position of the die 36 is limited relative to the inner clamp 72. As shown in FIG. 2, a nut 76 fastens the receiving ring 70 to the inner clamp 72. Retaining springs 78 are built in the receiving ring 70 to retain the die 36 upward to the limit position. That is, a bottom surface of the die 36 does not touch a top surface of the receiving ring 70 unless the die punch 42 pressurizes the die 36 downward.

As shown in FIG. 2, the outer clamp 74 is disposed out of the inner clamp 72. An inner surface of the outer clamp 74 tightly abuts an outer surface of the inner clamp 72. The outer clamp 74 thus is unitarily coupled with the inner clamp 72. Additional outer members embrace the clamp assembly 64 and fix it to the top surface of the base block 60.

A core member 82 extends vertically along the center axis CA through the base block 60 and the die unit 62. The core member 82 is preferably a solid bar. The core member 82 extends coaxially with the die 36. A spring (not shown) is disposed under the core member 82 to urge the core member 82 upward. A bottom end portion of the core member 82 is slightly thicker than the rest portion thereof. In other words, the bottom end portion of the core member 82 tapers upward, and the rest portion above the bottom end portion is a straight bar. The work 46 can be interposed between the die 36 and the core member 82. As shown in FIGS. 1 and 2, a top end portion of the core member 82 preferably extends upward beyond the stopper ring 68 to guide the work 46 when the work 46 is placed in the die 36.

The first punch 38 is placed above the core member 82. Preferably, the first punch 38 is generally a solid bar. A lower portion of the first punch 38, however, is cylindrical to form a recess 84 (FIG. 2) that can receive the top end portion of the core member 82 when the first punch 38 moves downward to the work 46. A bottom end of the lower portion of the first punch 38 can touch a top surface of the work 46.

The second punch 40 extends through the base block 60 and the die unit 62. A top end portion of the second punch 40 is fitted into the receiving ring 70. The second punch 40 preferably is a cylindrical member. The core member 82 extends through the second punch 40. A bottom end portion of the second punch 40 has an outer diameter larger than an outer diameter of the rest portion thereof. Push pins 88 extend below the second punch 40 for moving the second punch 40 upward. Top surfaces of the respective ejector pins 88 touch a bottom surface of the second punch 40. A lifter (not shown) is provided below the ejector pins 88. When the work 46 is finished, the lifter lifts the ejector pins 88 to move the work 46 upward via the second punch 40. The work 46 thus can be removed from the die unit 62.

With reference to FIG. 3, in the illustrated embodiment, an inner surface 90 of the stopper ring 68 tapers downward to form a female guide surface. A bottom end portion of the die punch 42 has an outer surface 92 tapering downward to form a male guide surface. As thus formed, the die punch 42 is press-fitted into the stopper ring 68 when the third pressurizing unit 56 moves the die punch 42 downward. A taper angle T which is measured from a hypothetical line extending parallel to the center axis CA is preferably equal to or less than three degrees, and more preferably, approximately two degrees. A press-fitted rate of the die punch 42 is preferably equal to or less than one percent, and more preferably, approximately 0.4%. Alternatively, for example, the taper angle T can vary in accordance with a depth of the surfaces 90, 92. That is, upper portions of the surfaces 90, 92 can have a taper angle which is, for example, two degrees, while lower portions of the surfaces 90, 92 have another taper angle which is less than two degrees. By changing the taper angle T in accordance with the depth, the press-fitted rate of the die punch 42 is adjustable.

In the illustrated embodiment, the die punch 42 is press-fitted into the stopper ring 68 before the first punch 38 is pressurized to the work 46. Because of this time lag, the die punch 42 can certainly guide the first punch 38 not to incline. In other words, the first punch 38 can move downward toward the work 46 with keeping the concentricity to the center axis CA. In this embodiment, bottom surfaces of the first punch 38 and the die punch 42 and top surfaces of the work 46 and the die 36 extend at right angles to the center axis CA under the normal condition. Thus, the keeping of the concentricity to the center axis CA means that die punch 42 always keeps the first punch 38 at right angles to the top surface of the die 36. That is, the first punch 38 does not incline relative to the die 36 and also to the center axis CA.

The taper angle T and the press-fitted rate are decided in accordance with the nature of the work 40 such as, for example, a size and a material. If the taper angle T is greater than three degrees, it can be difficult to keep the concentricity of the first punch 38 to the center axis CA (i.e., to keep the first punch 38 at right angles to the die 36). Also, if the press-fitted rate is greater than one percent, the contact surfaces 90, 92 can be less lubricated to cause seizure, or the stopper ring 68 can have cracks.

With reference to FIG. 1, as discussed above, the pressurizing section 34 includes the first, second and third pressurizing units 52, 54, 56.

The first pressurizing unit 52 preferably includes a main body 94 and a first punch holder 96.

The main body 94 receives the pressurizing force of the ram 48. The main body 94 preferably is a thick flat metallic plate 94 extending horizontally. The main body 94 has an axis which is consistent with the center axis CA. A top surface of the main body 94 is generally flat and extends parallel to a bottom surface of the ram 48 so as to touch the bottom surface of the ram 48 with a large area.

The first punch holder 96 depends from the main body 94 in a center portion of the main body 94 around the axis thereof. The first punch holder 96 is preferably unitarily fixed to the main body 94. The first punch holder 96 holds the first punch 38. The first punch holder 96 preferably is a generally cylindrical member having a step portion. The first punch 38 has a flange atop thereof. The step portion of the first punch holder 96 supports the flange of the first punch 38. A top surface 98 of the first punch 38 is formed flat and extends horizontally and contacts with the center portion of a bottom surface of the main body 94 which also extends horizontally. The top surface 98 of the first punch 38 thus can receive the pressurizing force from the first pressurizing unit 52.

With continuously reference to FIG. 1, the second pressurizing unit 54 preferably includes a pair of pressurizing members (first portion) 100, a pair of pressure receiving members (second portion) 102, a pair of intermediate members (fourth portion) 104 and a pressing member (third portion) 106. The respective pairs of the members 100, 102, 104 right oppose the counterpart thereof relative to the center axis CA. That is, they are spaced apart 180 degrees from each other.

The pressing member 106 has a recessed portion through which the core member 82 extends. The bottom end portion of the core member 82, which is slightly thicker, engages with the recessed portion of the pressing member 106. Under a condition that no-load is given to the first and second punches 38, 40 (i.e., the ram 48 does not pressurizes the main body 94 of the pressurizing unit 52), the core member 82 slightly lifts the pressing member 106 because the core member 82 is urged upward by the foregoing spring. The second punch 40 thus is also lifted together with the pressing member 106.

Each pressurizing member 100 is positioned in a peripheral portion of the main body 94 of the first pressurizing unit 52. In FIG. 1, each peripheral portion of the main body 94 having the respective pressurizing member 100 is shown as being developed from its actual position, and, thus, upper and lower parts of the pressurizing member 100 are illustrated as being separated from each other. Actually, however, the pressurizing member 100 is a single straightly extending member. The position of the lower part of the pressurizing member 100 indicates the actual position of each pressurizing member 100 from the center axis CA.

Each pressurizing member 100 in this embodiment includes a pressure receiving pin 110 and a cylindrical solid bar 112. The pressure receiving pin 110 depends from the main body 94 of the first pressurizing unit 52. More specifically, a head of the pressure receiving pin 110 engages a recessed portion of the main body 94 so that the pressure receiving pin 110 is suspended from the main body 94. A body of the pressure receiving pin 110 positioned under the head has an outer diameter larger than an outer diameter of the head to form a flat top surface 114 extending horizontally. The main body 94 of the first pressurizing unit 52 pressurizes the top surface 114 of the pressure receiving pin 110 when the main body 94 moves downward. In other words, the pressure receiving pin 110 can receive the portion of the pressurizing force of the first pressurizing unit 52.

The solid bar 112 is unitarily coupled with each pressure receiving pin 110. In the illustrated embodiment, the solid bar 112 is screwed into the pressure receiving pin 110. The pressure receiving pin 110 and the solid bar 112 extend vertically and parallel to the center axis CA. Each solid bar 112 has a flat surface extending horizontally at its bottom end.

The base block 60 has a pair of generally L-shaped hollows 118 extending opposite each other relative to the center axis CA in the interior of the base block 60. The pressure receiving members 102, the intermediate members 104 and the pressing member 106 extend in the respective hollows 118. Preferably, spaces in the hollows 118 are filled with lubricant oil.

Each pressure receiving member 102 preferably is a cylindrical solid bar and extends vertically right under the respective pressurizing member 100, specifically, the solid bar 112. An outer diameter of each pressurizing member 102 is preferably larger than an outer diameter of the solid bar 112 of the pressurizing member 100. A top surface of each pressure receiving member 102 is flat and extends horizontally to contact with the flat bottom surface of the respective solid bar 112 of the pressurizing member 100. A bottom surface of each pressure receiving member 102 preferably inclines 45 degrees from a center axis of the pressure receiving member 102.

The pressing member 106 preferably is a cylindrical member having an axis which is consistent with the center axis CA. The bottom portion of the core member 82 and the top portions of the respective ejector pins 88 extend through the pressing portion 106. The pressing member 106 is solid except for a center portion through which the core member 82 and the ejector pins 88 extend. The pressing member 106 has a pair of flat surfaces 120 facing the respective hollows 118. Preferably, each flat surface 120 inclines approximately 45 degrees relative to the center axis CA. A bottom surface of the second punch 40 faces a top surface of the pressing member 106.

Each intermediate member 104 preferably is a rectangular parallelepiped solid member or cylindrical solid member extending horizontally. One end of the intermediate member 104 has a flat surface 122 inclining approximately 45 degrees along the bottom surface of the respective pressure receiving member 102, while the other end of the intermediate member 104 has a flat surface inclining approximately 45 degrees along one of the flat surfaces 120 of the pressing member 106. That is, the flat surfaces 120, 122 form inclining cam surfaces. Each intermediate member 104 is connected to the respective pressure receiving member 102 and to the pressing member 106 through the inclining cam connections. By this structure, each intermediate member 104 can transmit the pressurizing force from the associated pressure receiving member 102 to the pressing member 106.

As shown in the left half part of FIG. 1, the pressurizing members 100 are positioned above the respective pressure receiving members 102 and do not touch the pressure receiving members 102 unless the ram 48 pressurizes the first pressurizing unit 52. When the ram 48 pressurizes the first pressurizing unit 52, the first pressurizing unit 52 moves downward and the main body 94 of the first pressurizing unit 52 pressurizes the respective pressurizing members 100. As shown in the right half part of FIG. 1, the bottom surfaces of the respective pressurizing members 100 collide with the top surfaces of the respective pressure receiving members 102. The respective pressure receiving members 102 thus push the respective intermediate members 104 to the pressing member 106 through the cam connections. The respective intermediate members 104, in turn, push the pressing member 106 through the other cam connections. Finally, the pressing member 106 pressurizes the second punch 40 upward to the work 46 in the die 36.

With still reference to FIG. 1, the third pressurizing unit 56 preferably includes a holding plate 126, a pair of damper assemblies 128 and a die punch holder 130.

The holding plate 126 preferably is a thick flat metallic plate extending horizontally below and parallel to the main body 94 of the first pressurizing unit 52. The illustrated holding plate 126, however, is thinner than the main body 94 of the first pressurizing unit 52. The holding plate 126 has an axis which is consistent with the center axis CA.

The holding plate 126 preferably depends from the main body 94 through the damper assemblies 128. In other words, the main body 94 suspends the holding plate 126 via the damper assemblies 128. The respective damper assemblies 128 are disposed next to the first punch holder 96 and oppose each other relative to the center axis CA. Each damper assembly 128 is preferably formed with elastic members 134, a metallic plate 136 and a guide pin 138. Each elastic member 134 is preferably made of a synthetic resin. Alternatively, a rubber material can be used. The respective elastic members 134 extend horizontally and parallel to the main body 94 of the first pressurizing unit 52 and interpose the metallic plate therebetween. The guide pin 138 extends vertically through the main body 94, elastic members 134, the metallic plate 136 and the holding plate 126. The guide pin 138 unifies each damper assembly 128 and guides the damper assembly 128 when the damper assembly 128 extends and contracts.

As shown in the left half part of FIG. 1, the damper assemblies 128 always urge the holding plate 126 downward. A peripheral portion of the holding plate 126 preferably extends outward beyond the cylindrical solid bar 112 of the pressurizing member 100. The cylindrical solid bar 112 extends through the peripheral portion of the holding plate 126. The solid bar 112 preferably has a step portion 142 that can support the peripheral portion of the holding plate 126 when the damper assemblies 128 urge the holding plate 126. As thus constructed, the holding plate 126 can move vertically in a certain distance when the damper assemblies 128 extend and contract. The solid bar 112 can guide the holding plate 126 when the holding plate 126 moves.

The die punch holder 130 is disposed in a center portion of the holding plate 126 around the axis thereof. The die punch holder 130 is preferably unitarily fixed to the holding plate 126. The die punch holder 130 holds the die punch 42. The die punch 42 is positioned between the die punch holder 130 and the first punch 38.

As shown in the left part of FIG. 1, a bottom end of the die punch 42 is positioned lower than a bottom end of the first punch 38, unless both of the punches 38, 42 are pressurized. The die punch 42 thus can touch the die 36 earlier than that the first punch 38 touches the work 46, when both of the punches 38, 42 are pressurized.

A top surface 144 of the die punch 42 is formed flat and extends horizontally and contacts with the center portion of a bottom surface of the holding plate 126 which also extends horizontally. The top surface 144 thus can receive the pressurizing force from the holding plate 126.

A time at which the first punch 38 touches the top surface of the work 46 is decided to be generally equal to a time at which the respective pressurizing members 100 (specifically, the respective solid bars 112) collide with the top surfaces of the respective pressure receiving members 102. Because the pressurizing force given from the respective pressurizing members 100 to the associated pressure receiving members 102 is instantly (without delay) transmitted to the pressing member 106 through the respective intermediate members 104, the pressing member 106 pressurizes the second punch 40 generally simultaneously when the first punch 38 touches the top surface of the work 46 so that the second punch 40 touches the bottom surface of the work 46 at this very moment.

In addition, a time at which the holding plate 42 starts press-fitting the die punch 42 into the stopper ring 68 of the clamp assembly 64 is decided to be earlier than the time at which the first punch 38 touches the top surface of the work 46. The die punch 42 thus touches the top surface of the die 36 before the first punch 21 touches the work 46. The die 36 moves downward relative to the die holder 66 against the urging force by the springs 78 to touch the receiving ring 70. The die 36 thus firmly holds the work 46 before the first and second punches 38, 40 pressurize the work 46.

Under this condition, the die punch 42, the die holder 66 and the receiving ring 70 together elastically deforms the die 36 so that a diameter of the die 36 becomes smaller. The die 36 locks the work 46 under this condition. The work 46 thus can be well shaped to have the desired gear teeth. In addition, no flashes or almost no flashes can be made at the top and bottom surfaces of the work 46, or even if flushes are made, the flushes can be extremely few.

In addition, preferably, a space 146 is made between a bottom end of the first punch holder 96 and a top surface of the holding plate 126. The space 146 allows the first punch 38 moves downward further in the state that the die 36 firmly holds the work 46 under the pressure of the die punch 42.

With reference to FIGS. 1-3, an overall operation of the forging device 30 will be described below.

First, the forging device 30 is in the state shown in the left half part of FIG. 1 unless the ram 48 pressurizes the pressurizing section 34. When the ram 48 starts pressurizing the main body 94 of the first pressurizing unit 52, the main body 94 moves downward to move the first punch 38 toward the work 46. Simultaneously, the main body 94 pressurizes the respective pressurizing members 100 of the second pressurizing unit 54. The pressurizing force of the main body 94 thus is transmitted to the pressing member 106 through the pressure receiving members 102 and the intermediate members 104. The first and second punches 38, 40 reach the work generally simultaneously. As shown in FIG. 2, at this moment, the work 46 is placed in the most appropriate position within the die 36.

On the other hand, when the main body 94 of the first pressurizing unit 52 moves downward, the main body 94 pressurizes the holding plate 126 through the damper assemblies 128. The holding plate 126 thus moves the die punch 42 downward toward the work 46. As discussed above, the time at which the holding plate 42 starts press-fitting the die punch 42 into the stopper ring 68 of the clamp assembly 64 is earlier than the time at which the first and second punches 38, 40 start pressurizing the work 46 from its top and bottom ends. The die 36 thus already locks the work 46 before the first and second punches 38 compress the work 46.

When the first and second punches 38, 40 fully pressurize the work 46 from both the ends thereof in its axial direction generally simultaneously under the condition that the die 36 locks the work 46, the work 46 is plastically deformed. That is, the top and bottom portions of the work 46 flow toward the center thereof in the axial direction. The work 46 is firmly pressed to the inner teeth 36*a* of the die 36 and the configuration of the inner teeth 36*a* is transferred to the work 46.

According to the forging device 30 in the embodiment, the equal pressurizing force can be given to the top and bottom ends of the work generally simultaneously. The configuration of the teeth of the die thus can be accurately transferred to the work.

Because the die punch 42 is press-fitted into the stopper ring 92 along the tapering inner and outer surfaces 90, 92 in the embodiment, the axis of the first punch 38 is kept to be consistent with the center axis CA, and also the first punch 38 and the die 36 can be kept coaxially. In other words, the first punch 38 does not incline relative to the center axis CA and to the die 36. The work 46, which is originally a cylindrical blank, thus can be shaped to be a gear that has a high concentricity.

Also, by previously giving a compressive strain to the die punch 42 against an internal pressure generated in the die punch 42 under the forging process, the breakage of the die punch 42 caused by the internal pressure can be avoided.

Figure 4:
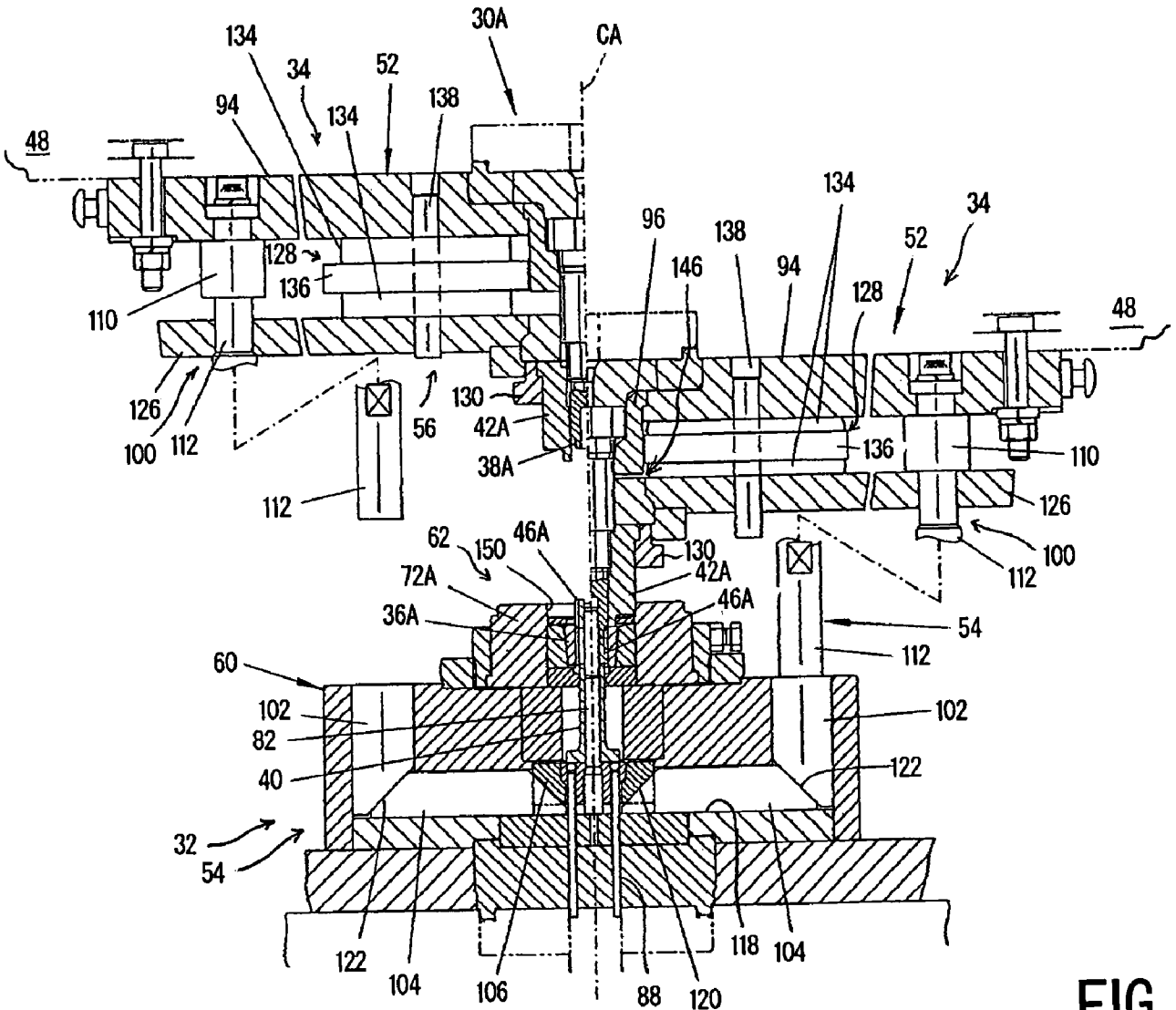
FIG. 4 is a cross sectional view of the major part of another forging device configured in accordance with a second embodiment of the present invention.
Figure 5:
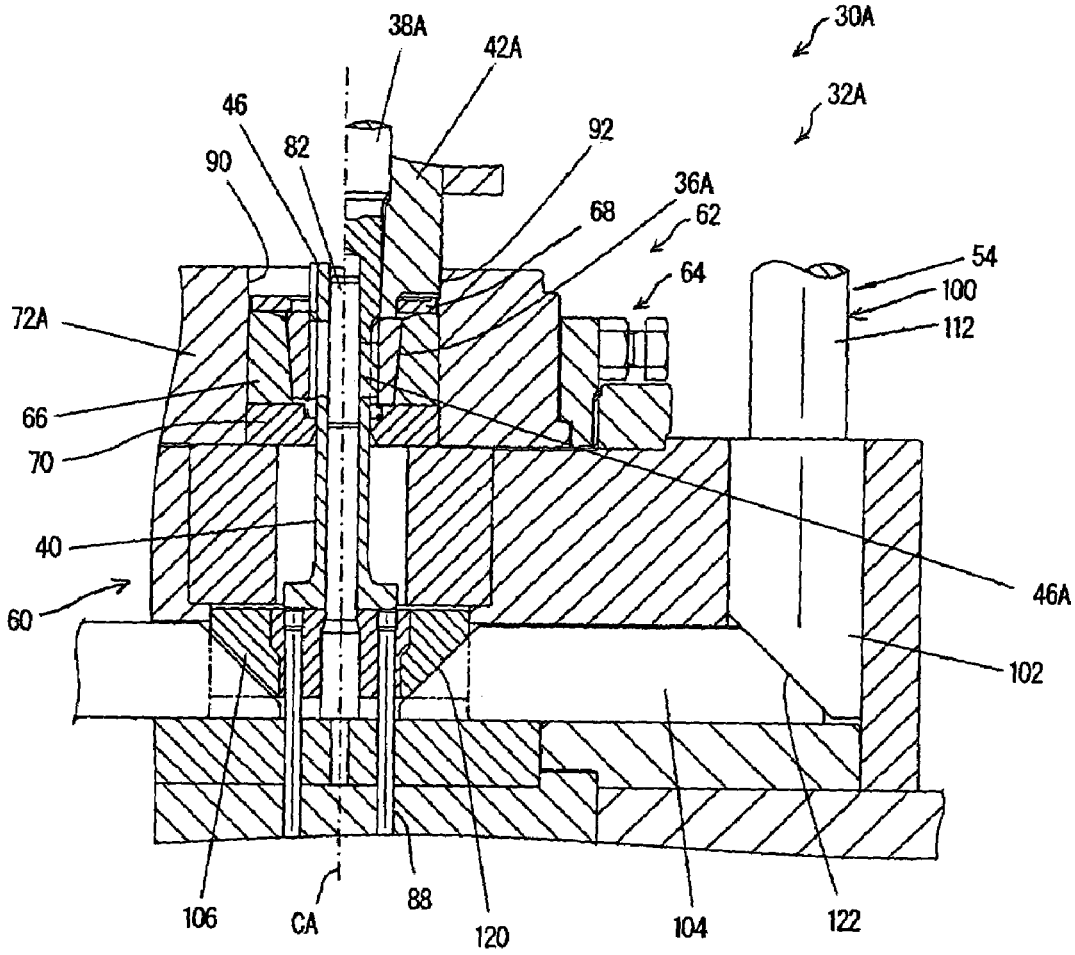
FIG. 5 is an enlarged cross sectional view of the forging device of FIG. 4, showing first, second and third die punches and a part of a die section of the forging device of FIG. 4.
Figure 6:
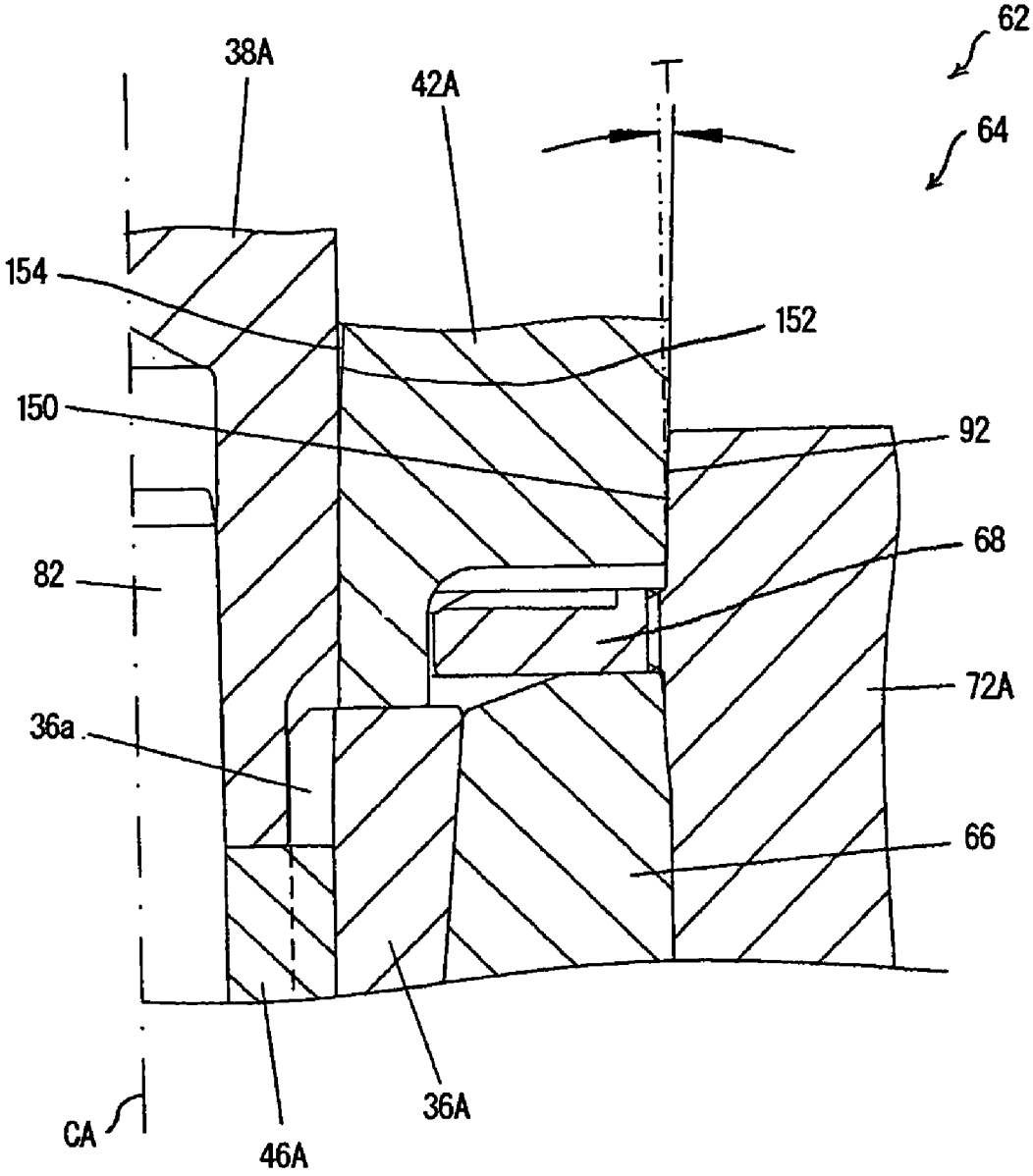
FIG. 6 is a further enlarged cross sectional view of the forging device of FIG. 4, partially showing first and third die punches and a die unit of the die section of FIG. 5.

With reference to FIGS. 4-6, a modified forging device 30A configured in accordance with a second embodiment of the present invention will be described below. The same or similar members, units, assemblies and components as or to those which are described above will be assigned with the same reference numerals or with reference numerals followed by some symbols, and will not be described repeatedly unless further descriptions are necessary or appropriate. This manner is also applied to the descriptions of other embodiments provided below.

The forging device 30A in this embodiment is particularly suitable for finishing half-finished products or intermediate workpieces such as, for example, the gears shaped from the works 46 of the first embodiment. The forging device 30A, however, can be of course used for shaping virgin works. The forging device 30A will be described as the finishing forging device that finishes the helical gears shaped from the virgin works 46 by the forging device 30 of the first embodiment.

The finishing forging device 30A preferably includes, as the major part thereof, first, second and third (die) punches 38, 40, 42A, a die section 32A placed on a base 47 and a pressurizing unit 52 positioned above the die section 32A. Those components have the same or similar structures to the corresponding components in the first embodiment.

In this embodiment, a single clamp 72A replaces the inner and outer clamps 72, 74 of the first embodiment. Differing from the first embodiment, the die punch 42A has an outer surface 92 that can directly touch an inner surface 150 of the clamp 72A, although an upper (stopper) ring 68A is used. That is, in the second embodiment, the inner surface 150 of the clamp 72A tapers downward to form the female guide surface, while the outer surface 92 of the die punch 42A tapers downward to form the male guide surface.

The die punch 42A is press-fitted into the clamp 72A when a third pressurizing unit 56 moves the die punch 42A downward. As shown in FIG. 6, the taper angle T in this embodiment is preferably equal to the taper angle defined between a finishing die 36A and a die holder 66, and is approximately five degrees.

In the second embodiment, as best shown in FIG. 6, the first punch 38A also has an outer surface 152 tapering downward and the die punch 42A has an inner surface 154 tapering downward so that the first punch 38A can be press-fitted into the die punch 42A. The taper angle of these portions preferably is the same as the taper angle T defined between the die punch 42A and the clamp 72A, and is approximately five degrees.

In the second embodiment, a workpiece 46A, which is the half-finished product forged from the work 46, is put on a top end portion of the finishing die 36A by a hand of a human operator to engage the die 36A. Then, the ram 48 is operated to lower the first pressurizing unit 52. The first punch 38A thus pushes the workpiece 46A into a certain place of the die 36A where the workpiece 46A is forged.

The die punch 42A does not touch the die 36A when the first punch 38A starts pressurizing the workpiece 46A. This is because, as shown in the left part of FIG. 4, a bottom end of the first punch 38A is positioned lower than a bottom end of the die punch 42A unless both the punches 38A, 42A are pressurized.

Afterwards and when the first punch 38A starts pressurizing the workpiece 46A downward from its top end, the respective pressurizing members 100 collide with the associated pressure receiving members 102. The pressing member 106 thus pressurizes the workpiece 46A upward from its bottom end through the pressure receiving members 102 and the intermediate members 104.

In the above condition, the die punch 42A is press-fitted into the space made between the clamp 72A and the first punch 38A along the taper surfaces. Because of the taper surfaces, the first punch 38A can keep the concentricity with the center axis CA. That is, the first punch 38A does not incline and is held at right angles to the die 36A.

The first pressurizing unit 52 pressurizes the damper assemblies 128 to compress the damper assemblies 128. The damper assembly 128 increases the pressure given to the die 36A through the die punch 42A. That is, the die punch 42A moves the die 36A downward relative to the die holder 66 to urge the die punch 42A to the receiving ring 70 while elastically deforming the die 36A so that the diameter of the die 36A becomes smaller.

Thus, the workpiece 46A is shaped to be a fine gear that has the highly accurate concentricity and has the sufficient dimensional accuracy top to bottom. Also, by previously giving a compressive strain to the die punch 42A against an internal pressure generated in the die punch 42A under the shaping process, the breakage of the die punch 42 caused by the internal pressure can be avoided.

The workpieces 46A, which are the half-finished products forged from the works 46, are further forged by the finishing forging device 30A of the second embodiment. However, other workpieces which are made in a cutting process or in other processes can be alternatively forged by the finishing forging device 30A.

Figure 7:
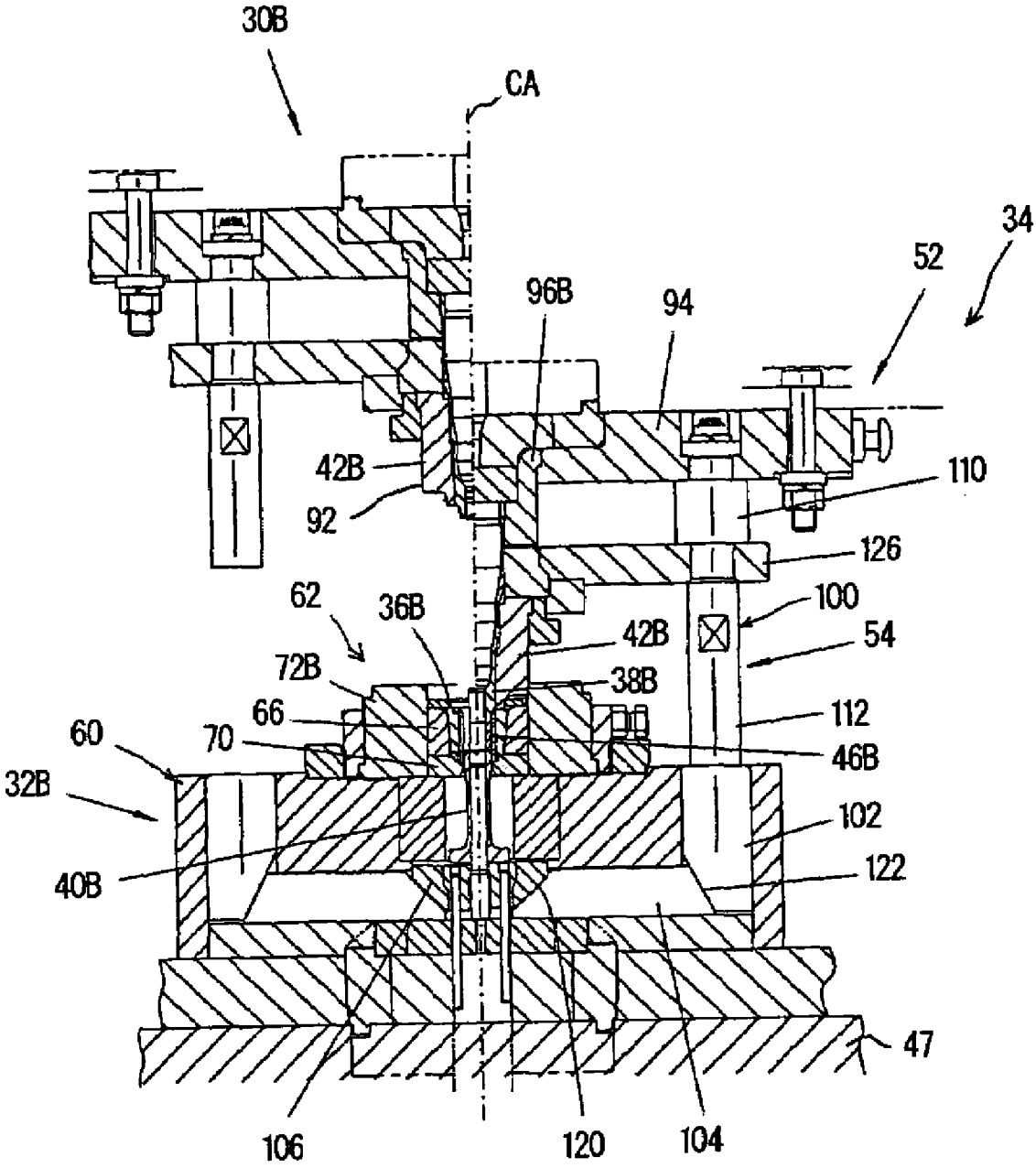
FIG. 7 is a cross sectional view of the major part of a further forging device configured in accordance with a third embodiment of the present invention.
Figure 8:
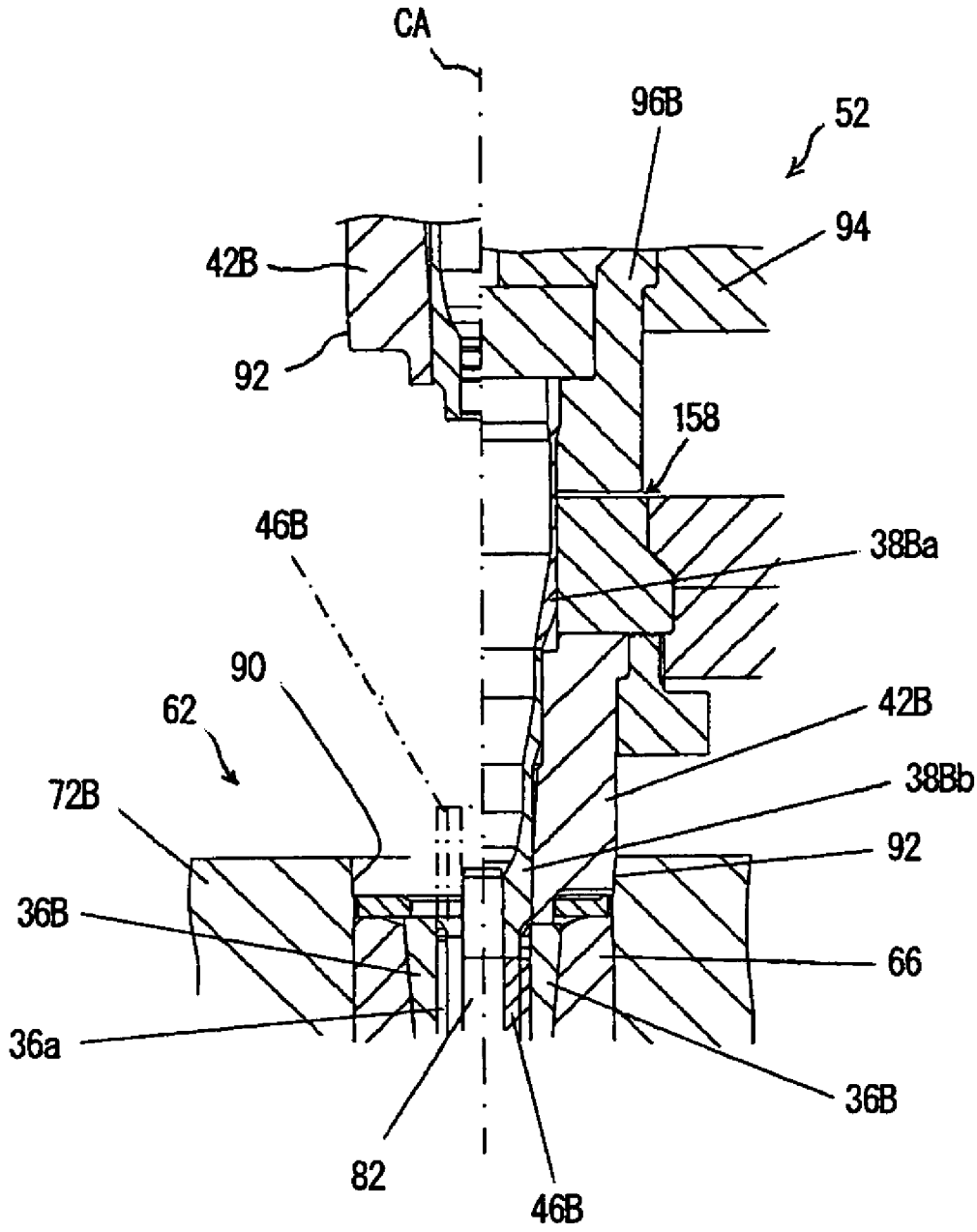
FIG. 8 is an enlarged cross sectional view of the forging device of FIG. 7, partially showing first and third die punches, a die section and a pressurizing section of the forging device of FIG. 7.

With reference to FIGS. 7 and 8, another modified forging device 30B configured in accordance with a third embodiment of the present invention will be described below.

The forging device 30B is another example of a finishing forging device. The forging device 30B, however, can be used for forging virgin works. The forging device 30B preferably includes, as the major part, a first, second and third (die) punches 38B, 40B, 42B, a die section 32B placed on the base 47 and a pressurizing section 34B positioned above the die section 32B.

The first punch 38B in this embodiment includes thin and cylindrical lower and upper punch members 38Ba, 38Bb both disposed vertically in series with each other. The first punch 38B can be slightly elastically deformed in its axial direction when a workpiece 46B is pressurized. The lower punch member 38Bb of the first punch 38B can extend downward more than the die punch 42B by a certain distance.

The second punch 40B is a cylindrical member similar to the second punch 40 of the first and second embodiments. The second punch 40B in this embodiment, however, is thinner than the second punch 40. The second punch 40B thus can be slightly elastically deformed in its axial direction when the workpiece 46B is pressurized.

Additionally, the die punch 42B is almost the same as the die punch 42A of the second embodiment.

In this embodiment, the pressurizing section 34B has no damper assemblies. The pressurizing member 100 of a second pressurizing unit 54 supports a holding plate 126B of a third pressurizing unit 56. The pressurizing force given to the second pressurizing unit 54 from the main body 94 of the first pressurizing unit 34B is bifurcated to the rest of the second pressurizing unit 54 (i.e., the pressure receiving members 102) and to the third pressurizing unit 56 (i.e., holding plate 126B). A center portion of the holding plate 126B can be slightly elastically deformed upward by the load of the die punch 42B. As best shown in FIG. 8, a space 158 is made between a bottom end of the first punch holder 96 and a top surface of the holding plate 126B to allow the upward deformation of the holding plate 126B.

Additionally, in the third embodiment, a taper angle defined between an outer surface (male guide surface) 92 of the die punch 42B and an inner surface (female guide surface) 150 of a clamp 72B is preferably equal to a taper angle formed between a die 36B and a die holder 66, and is approximately five degrees.

The other structures of the forging device 30B are similar to the forging device 30A described above.

When the ram 48 lowers the pressurizing section 34, the first punch 38B pushes the workpiece 46B, which is put on an upper portion of the die 36, to the die 36 by the certain distance to place the workpiece 46B to the position where the workpiece 46B is forged. The die punch 42B press-fits the die 36B into the die holder 66 to elastically deform the die 36B so that an outer diameter of the die 36B becomes smaller. After the die 36B touches the receiving ring 70, i.e., the die 36B is completely press-fitted into the die holder 66, the first punch 38B further moves downward while the center portion of the holding plate 126B is elastically deformed. Simultaneously, the second pressurizing unit 54 pressurizes the second punch 40B. The first punch 38B and the second punch 40B together compress the workpiece 46B in the axial direction to bring the worpiece 46B to its stress range in which the workpiece 46B can be plastically deformed. Thereby, the configuration of the teeth of the die 36 is transferred to the teeth of the workpiece 46B.

Because the first punch 38B and the second punch 40B are thinner cylindrical members, the first and second punches 38B, 40B can be elastically deformed in their axial directions when the workpiece 46B is compressed. Thus, even if the weight (size) of individual workpieces 46B varies, the internal pressure of the respective workpieces 46B under the forging process can be generally equal to each other. Every product, which is the finished workpiece 46B, can have a desired and constant teeth configuration.

Figure 9:
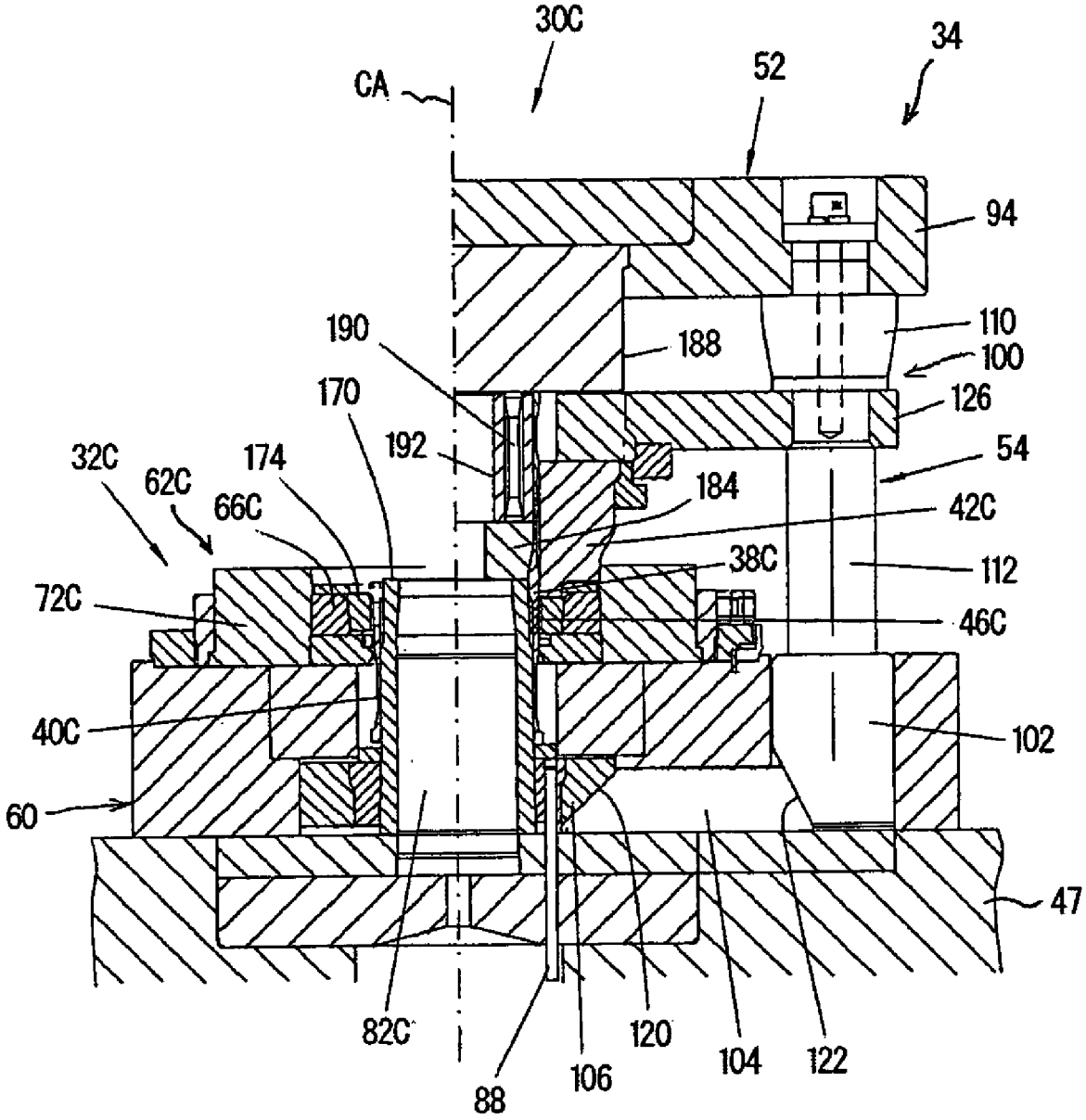
FIG. 9 is a cross sectional view of the major part of a still further forging device configured in accordance with a fourth embodiment of the present invention.
Figure 10:
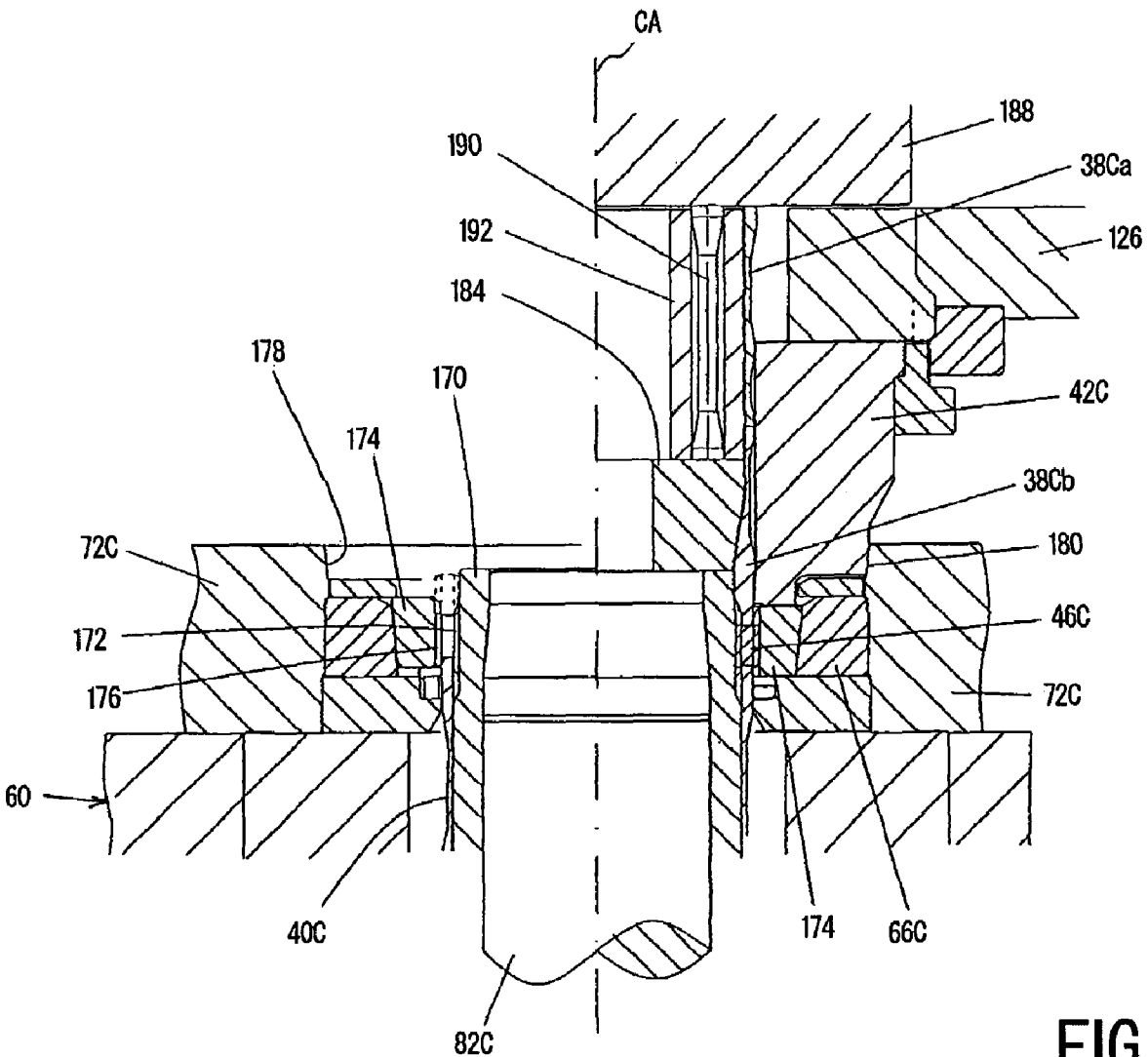
FIG. 10 is an enlarged cross sectional view of the forging device of FIG. 9, partially showing first, second and third die punches, a die section and a pressurizing section of the forging device of FIG. 9.

With reference to FIGS. 9 and 10, a further modified forging device 30C configured in accordance with a fourth embodiment of the present invention will be described below.

The forging device 30C is a further example of the finishing forging device. The forging device 30C is particularly useful for finishing ring gears which have rough teeth on its inner and outer surfaces. However, the forging device 30C of course can be used for forging virgin works.

In this embodiment, an inner die 170 is placed around a core member 82C. The core member 82C has a relatively large outer diameter. A top end portion of the inner die 170 and a top end portion of the core member 82C both taper upward by approximately five degrees. An outer surface of the inner die 170 has outer teeth 172 for shaping inner gear teeth. An outer die 174 is placed around the inner die 170 coaxially and is spaced apart from the inner die 170.

Because the core member 82C has the large outer diameter and the inner and outer dies 170, 174 are provided, first and second punches 38C, 40C and components of the die unit 62C in this embodiment have larger diameters to surround them. Other than the diameters, the first and second punches 38C, 40C are similar to those which are described in the third embodiment.

The outer die 174 is fitted into a die holder 66C. The die holder 66C abuts the outer die 174 with taper surfaces tapering downward by approximately five degrees. An inner surface of the outer die 174 has inner teeth 176 for shaping outer gear teeth.

The die holder 66C is press-fitted into a clamp 72C. A top end portion of the clamp 72C extends upward more than the die holder 66C. An inner surface 178 of the top end portion of the clamp 72C tapers downward to form a female guide surface. An outer die punch 42C has an outer surface 180 which tapers downward to form a male guide surface. The taper angle defined between the inner surface 178 of the clamp 72C and the outer surface 180 of the outer die punch 42C is preferably approximately five degrees. The taper angle is generally equal to a taper angle defined between the inner die 170 and the core member 82C, and to the taper angle defined between the outer die 174 and the die holder 66C.

An inner die punch 184 is also provided in this embodiment to press the inner die 170. That is, the inner die punch 184 is positioned inside of the first punch 38C to press the inner die 170 downward, while the outer die punch 42C is positioned outside of the first punch 38C to press the outer die 174 downward.

A pressure plate 188 is preferably fixed to a main body 94C of the pressurizing unit 52. The pressure plate 188 can pressurize the first punch 38C downward when the ram 48 pressurizes the pressurizing unit 52. Preferably, three pressure pins 190 are disposed inside of the first punch 38C around the center axis CA below the pressure plate 188. The pressure plate 188 also pressurizes the respective pressure pins 190. The pressure pins 190 thus pressurize the inner die punch 184 downward. Each pressure pin 190 preferably has a relatively small diameter so as to be elastically deformed in its axial direction after the pressure pin 190 has pressed the inner die 170 downward around the core member 82C with a certain distance through the inner die punch 184. A cylindrical holder 192 preferably holds and protects each pressure pin 190. The holder 192 is slightly shorter than the pressure pin 190 not to hinder the elastic deformation of the associated pressure pin 190.

Similarly to the holding plate 126B of the third embodiment, the holding plate 126C of this embodiment can be elastically deformed upward after the outer die punch 42C pushes the outer die 174 into the die holder 66C with the certain distance.

When the ram 48 lowers the pressurizing section 34, the first punch 38C pushes the workpiece 46C, which is placed by the human operator, into the space made between the inner die 170 and the outer die 174 by a certain distance. The inner die punch 184 moves the inner die 170 downward, and the outer die punch 42C simultaneously moves the outer die 174 downward, relative to the core member 82C and the die holder 66C. Thereby, the inner die 170 is elastically deformed so that an outer diameter of the inner die 170 becomes larger, while the outer die 174 is elastically deformed so that an inner diameter of the outer die 174 becomes smaller.

After the inner die 170 and the outer die 174 have been press-fitted, the respective pressure pins 190 are elastically deformed in their axial directions, and also the center portion of the holding plate 126C is elastically deformed upward. The first punch 38C thus further moves downward. Simultaneously, the second pressurizing unit 54 pressurizes the second punch 40C. The first punch 38C and the second punch 40C together compress the workpiece 46C in the axial direction to bring the worpiece 46C to its stress range in which the workpiece 46C can be plastically deformed. Thereby, the configurations of the outer teeth of the inner die 170 and the inner teeth of the outer die 174 are transferred to the outer and inner teeth of the workpiece 46C.

Similarly to the third embodiment, because the first punch 38C and the second punch 40C are thinner and cylindrical members, the first and second punches 38C, 40C can be elastically deformed in their axial directions when the workpiece 46C is pressurized. Thus, even if the weight (size) of individual workpieces 46C varies, the internal pressure of the respective workpieces 46C under the forging process can be generally equal to each other. Every product, which is the finished workpiece 46C, can have a desired and constant teeth configuration.

Although the present invention has been disclosed in the context of certain preferred embodiments, it will be understood by those skilled in the art that the present invention extends beyond the specifically disclosed embodiments to other alternative embodiments and/or uses of the invention and obvious modifications and equivalents thereof. It is also contemplated that various combinations or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A forging device comprising:

a die having an axis extending generally vertically, the die receiving a work placed in the die along the axis;

first and second punches extending coaxially with the die and being capable of interposing the work therebetween; and a pressurizing section for pressurizing the first and second punches toward the work generally simultaneously, the pressurizing section comprising a first pressurizing unit for pressurizing the first punch downward and a second pressurizing unit for pressurizing the second punch upward; and a base block for supporting the die, wherein at least a portion of the second punch extends in the base block; and wherein the first pressurizing unit moves downward when the first pressurizing unit pressurizes the first punch, and at least a portion of the second pressurizing unit moves downward together with the first pressurizing unit when the second pressurizing unit pressurizes the second punch;

wherein the second pressurizing unit comprises a first portion extending downward from the first pressurizing unit and moving together with the first pressurizing unit, a second portion extending generally vertically in the base block and moved by the first portion when the second pressurizing unit pressurizes the second punch, a third portion positioned under the second punch, and a fourth portion extending generally horizontally to connect the third portion to the second portion so that the third portion moves together with the second portion; and wherein the second portion and the fourth portion are connected through a cam connection.

2. The forging device according to claim 1, wherein the pressurizing section generally equally pressurizes the first and second punches.

3. A forging device comprising:

a die having an axis extending generally vertically, the die receiving a work placed in the die along the axis, the die laterally surrounding the work;

first, second and third punches extending coaxially with the die and being capable of interposing the work therebetween;

a pressurizing section for pressurizing the third punch toward the die;

a clamp for clamping the third punch, the third punch generally extending along the first punch, the clamp and the first punch interposing the third punch therebetween when the first punch is pressurized to the work, the third punch or the first punch having an outer guide surface tapering downward, the clamp or the third punch having an inner guide surface tapering downward and corresponding to the outer guide surface, and the third punch being press-fitted into the clamp along the outer and inner guide surfaces when the first punch is pressurized to the work, or the first punch being press-fitted into the third punch along the outer and inner guide surfaces when the first punch is pressurized to the work.

4. The forging device according to claim 3, wherein the pressurizing section comprises a first pressurizing unit for pressurizing the first punch downward and a second pressurizing unit for pressurizing the second punch upward.

5. The forging device according to claim 4, wherein the first pressurizing unit moves downward when the first pressurizing unit pressurizes the first punch, and at least a portion of the second pressurizing unit moves downward together with the first pressurizing unit when the second pressurizing unit pressurizes the second punch.

6. The forging device according to claim 5, further comprising a base block for supporting the die, wherein at least a portion of the second punch extends in the base block, the second pressurizing unit comprises a first portion extending downward from the first pressurizing unit, the first portion moves together with the first pressurizing unit, a second portion extends generally vertically in the base block, and the first portion moves the second portion when the second pressurizing unit pressurizes the second punch.

7. The forging device according to claim 6, wherein the second pressurizing unit further comprises a third portion positioned under the second punch, and a fourth portion extending generally horizontally to connect the third portion to the second portion so that the third portion moves together with the second portion.

8. The forging device according to claim 7, wherein the second portion and the fourth portion are connected through a cam connection.

9. The forging device according to claim 7, wherein the third portion and the fourth portion are connected through a cam connection.

10. The forging device according to claim 4, wherein the first pressurizing unit pressurizes the second pressurizing unit.

11. The forging device according to claim 4 wherein a third pressurizing unit starts pressurizing the third punch before the first pressurizing unit starts pressurizing the first punch.

12. The forging device according to claim 11, wherein the die laterally surrounds the work, and the die locks the work when the third pressurizing unit pressurizes the third punch.

13. A forging device comprising:

a die having an axis extending generally vertically, the die receiving a work placed in the die along the axis, the die laterally surrounding the work;

first, second and third punches extending coaxially with the die and being capable of interposing the work therebetween;

a pressurizing section for pressurizing the first and second punches toward the work generally simultaneously, the pressurizing section comprising a first pressurizing unit for pressurizing the first punch downward, second pressurizing unit for pressurizing the second punch upward and a third pressurizing unit for pressurizing the third punch toward the die;

a core member interposing the work with the die; and wherein the die locks the work together with the core member when the third pressurizing unit pressurizes the third punch; and wherein the third pressurizing unit starts pressurizing the third punch before the first pressurizing unit starts pressurizing the first punch.

14. A forging device comprising:

a die having an axis extending generally vertically, the die receiving a work placed in the die along the axis;

first, second and third punches extending coaxially with the die and being capable of interposing the work therebetween;

a pressurizing section for pressurizing the first and second punches toward the work generally simultaneously, the pressurizing section comprising a first pressurizing unit for pressurizing the first punch downward, a second pressurizing unit for pressurizing the second punch upward and a third pressurizing unit for pressurizing the third punch toward the die;

wherein the third pressurizing unit starts pressurizing the third punch before the first pressurizing unit starts pressurizing the first punch;

wherein the first pressurizing unit pressurizes the third pressurizing unit; and wherein the first pressurizing unit and the third pressurizing unit are coupled with each other through a damper.

* * * * *